US005573117A

United States Patent [19]

Adams

[11] Patent Number: 5,573,117

[45] Date of Patent: Nov. 12, 1996

[54] PRODUCT SHIPPING AND DISPLAY SYSTEM

[75] Inventor: William E. Adams, Portersville, Pa.

[73] Assignee: Adams Mfg. Corp., Portersville, Pa.

[21] Appl. No.: 456,728

[22] Filed: Jun. 1, 1995

[51] Int. Cl.[6] ..... B65D 1/34

[52] U.S. Cl. ..... 206/449; 206/564; 206/470; 206/467; 206/504

[58] Field of Search ..... 206/449, 561, 206/564, 461, 462, 467, 468, 469, 470, 504, 587, 95.19; D9/456

[56] References Cited

U.S. PATENT DOCUMENTS

| | | | |
|---|---|---|---|
| D. 180,590 | 7/1957 | Emery | 58/13 |
| D. 197,631 | 3/1964 | Caprioli | 58/13 |
| D. 197,633 | 3/1964 | Caprioli | 58/13 |
| D. 244,580 | 6/1977 | Keough | 9/189 |
| D. 244,581 | 6/1977 | Keough | 9/189 |
| D. 246,491 | 11/1977 | D'Alo | 6/188 |
| 537,853 | 4/1895 | Ramsay | 206/561 |
| 1,659,509 | 2/1928 | Ashbrook | 206/564 X |
| 1,764,216 | 6/1930 | Laubenheimer | 206/45.19 |
| 2,094,834 | 10/1937 | Bowman | 206/564 X |
| 2,249,265 | 7/1941 | Bauder | 206/564 X |
| 3,187,889 | 6/1965 | Sinclair | 206/461 |
| 3,313,407 | 4/1967 | Palm, Jr. | 206/461 X |
| 3,521,808 | 7/1970 | Weiss | 229/15 |
| 3,559,866 | 2/1971 | Olson, Sr. | 229/14 |
| 3,721,339 | 3/1973 | Seyer | 206/504 X |
| 4,408,693 | 10/1983 | Brewaeys et al. | 206/461 |
| 4,569,442 | 2/1986 | Bushey | 206/469 |
| 4,832,208 | 5/1989 | Finnegan | 206/564 X |
| 5,209,354 | 5/1993 | Thornhill et al. | 206/469 |
| 5,316,138 | 5/1994 | Thompson | 206/564 X |

*Primary Examiner*—Paul T. Sewell
*Assistant Examiner*—Tara L. Laster
*Attorney, Agent, or Firm*—Buchanan Ingersoll, P.C.; Lynn J. Alstadt

[57] ABSTRACT

A system for displaying packaged goods has an insert sized to be placed on a bottom surface of a packaging carton. The insert has a plurality of alternating peaks and valleys. Each peak has a front wall, a rear wall having a height greater than the front wall and a sloped top extending from the front wall to the rear wall. Each valley is sized to receive a bottom portion of a blister package. A blister package comprised of a card portion, and blister portion attached to the card portion is sized and configured so that a plurality of blister packages can be placed in front to back relationship and a bottom edge of each blister package will fit into a valley in the insert.

6 Claims, 4 Drawing Sheets

PRODUCT SHIPPING AND DISPLAY SYSTEM

FIELD OF THE INVENTION

The invention relates to a system for shipping and displaying products that are packaged on blister cards.

BACKGROUND OF THE INVENTION

Many products are sold in blister packages. In most of these packages the article, is placed on a piece of cardboard and then covered by a plastic bubble which is attached to the cardboard. Some blister packages use a plastic back rather than cardboard. Typically, blister packages are shipped in larger shipping cartons to the point of sale. There the blister packages are removed from the shipping carton and displayed. Usually, blister packages are hung on racks.

Many retail stores are selling articles directly from their shipping containers. This permits them to reduce their labor cost because they no longer need to remove the products from the shipping containers and place them on display racks. The preferred practice is simply to cut away a portion of the shipping container, leaving the product to be displayed on the remaining portion of that shipping carton. Preferably a sufficient part of the shipping container is cut away so that the product can be easily seen by the passing customer.

Because of their shape and the location of their center of gravity, most blister packages tend to fall over when placed in an upright position. Consequently, for blister packages to be displayed in a cut-away shipping container, it is necessary to provide a support structure to hold the blister packages in an upright position. A simple system which has been proposed utilizes an insert which is positioned adjacent opposite sides of the blister packages. The insert has slots into which the opposite edges of the blister packages are fitted. This type of insert is placed on opposite sidewalls of the shipping carton. However, when a vendor displays merchandise in a shipping container, he usually removes the top and most of the sidewalls. Hence, those support inserts that are attached to sidewalls are usually cut away from the sidewalls. If the shipping container is cut in a manner so as to leave the inserts in place, they partially obscure the blister cards and tend to be a distraction.

There have been proposed a variety of trays each having a base with a series of slots or valleys cut or formed in the base. The trays have been proposed to hold a variety of objects including blister packages. One shortcoming of the trays, however, is that after a few blister packages are removed the remaining packages tend to fall forward or backward. This occurs because the trays do not adequately support the blister packages.

There is a need, therefore, for a system which enables blister packages to be displayed in their shipping container. Preferably, the system permits a portion of the shipping container to be cut away leaving the blister packages in an upright display from which they will not fall even after some blister packages have been removed from the display.

SUMMARY OF THE INVENTION

I provide a blister package shipping and display system which utilizes an insert or tray provided in the bottom of the shipping carton. The blister package may also be a clam shell package having a back which is attached by a hinge to a front blister portion. The back preferably has a raised landing which snap fits into a mating cavity in the front portion. The blister extends from that mating cavity and is designed to have a flat bottom portion which protrudes from the cavity, preferably at an acute angle. A tray is provided in the bottom of the shipping container. The tray has a series of parallel peaks and valleys. The valleys have a width which enables the bottom edge of the back portion of the blister package to fit securely therein. The peaks are shaped so that the back wall of each peak is higher than the front wall thereof. Thus, the top surface of each peak is oriented at an angle from the back to the front. I prefer that the angle between the back wall and the top is approximately the same as the acute angle formed by the bottom of the blister. When such a blister package or clam shell package is placed within the tray, the sloping or angled bottom of the blister fits over the sloping or angled top of a peak securely holding the blister package in an upright position. When the preferred package is used the front face of the blister fits within the cavity formed by the landing in the blister package ahead of it. This provides added stability.

Other objects and advantages of the invention will become apparently from a description of the present preferred embodiment shown in the drawings.

DESCRIPTION OF THE PREFERRED EMBODIMENTS

Figure 1:
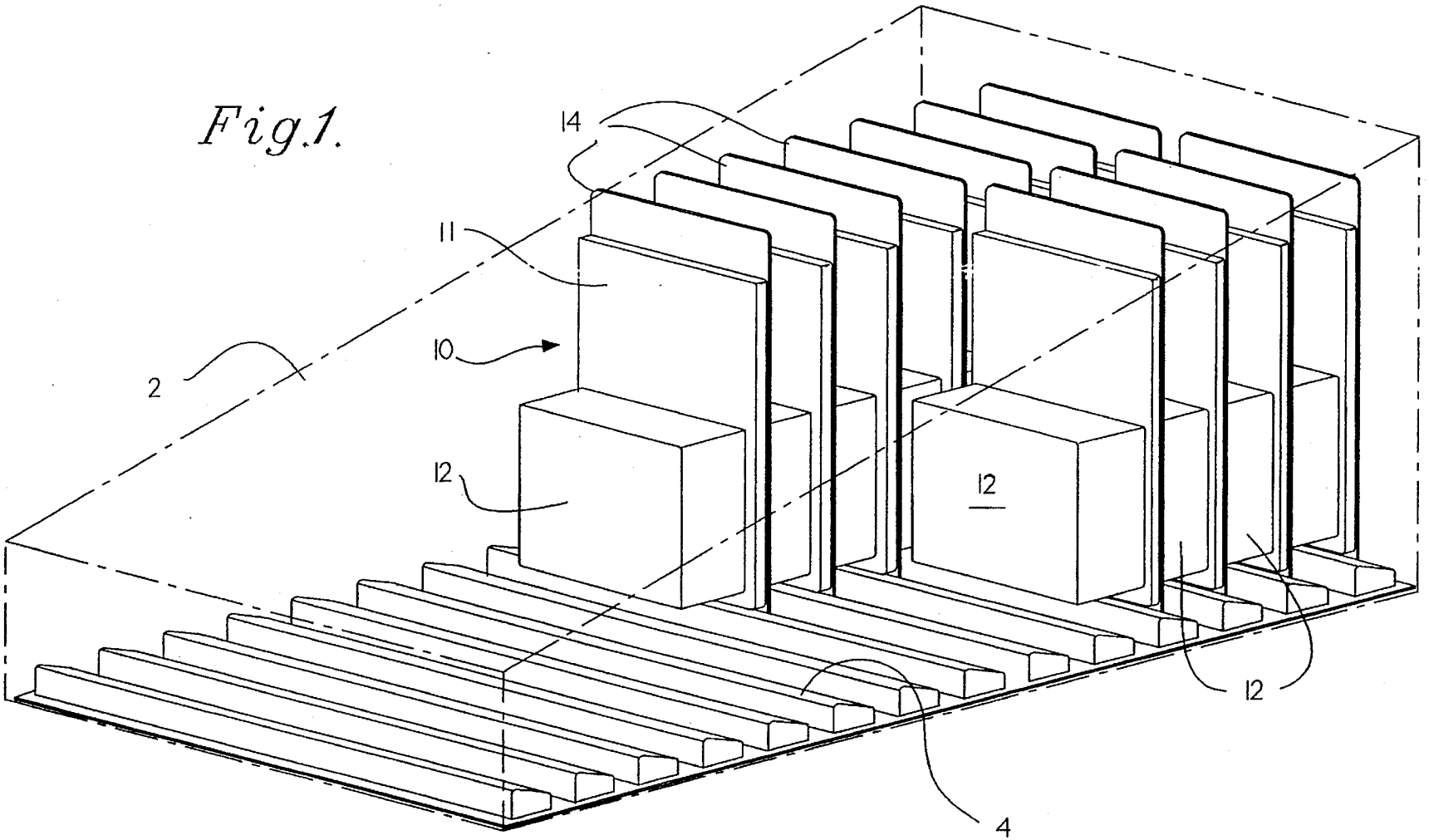
FIG. 1 is a perspective view of the present preferred embodiment of my shipping and display system.
Figure 3:
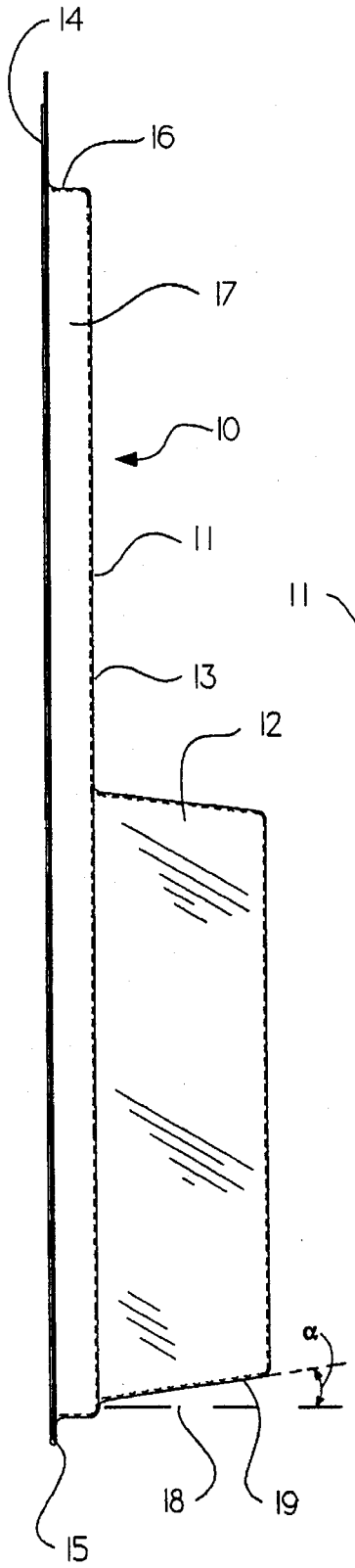
FIG. 3 is a side view of the blister package shown in FIG. 2.
Figure 2:
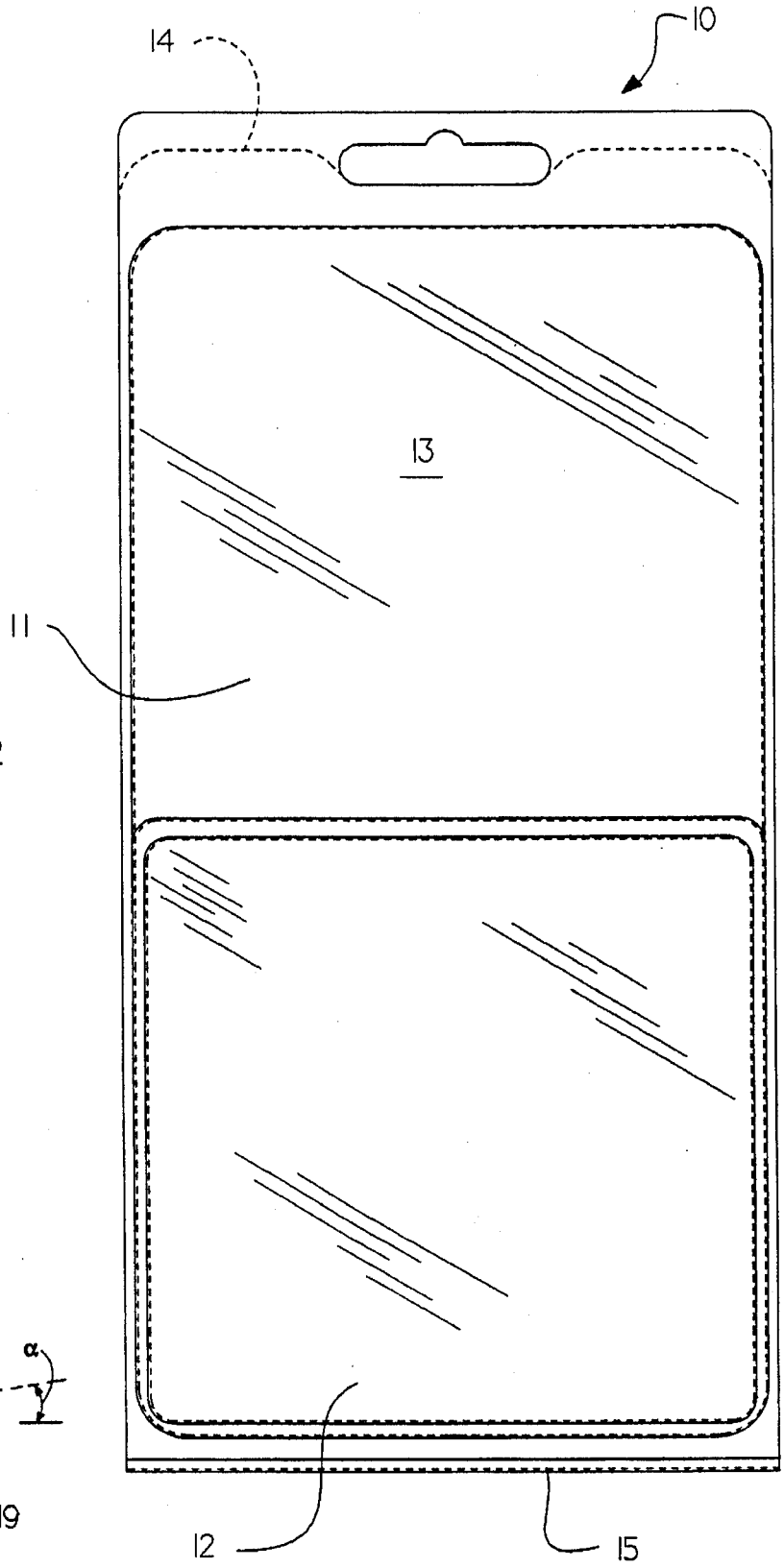
FIG. 2 is a front view of a present preferred blister package used in the present system.

The present system is designed for use in a standard cardboard packing carton 2 shown in chainline in FIG. 1. An insert or tray 4 is placed in the bottom of the carton. A desired number of blister packages 10 are arranged front to back within the shipping container as shown in FIG. 1. When the container reaches the store, the upper portion of the shipping container is cut away leaving the bottom and a portion of the sidewalls such as is shown in FIG. 1. The sidewalls may be cut to form the shape shown in FIG. 1 or cut along the line parallel to the top and bottom of the shipping container.

Figure 4:
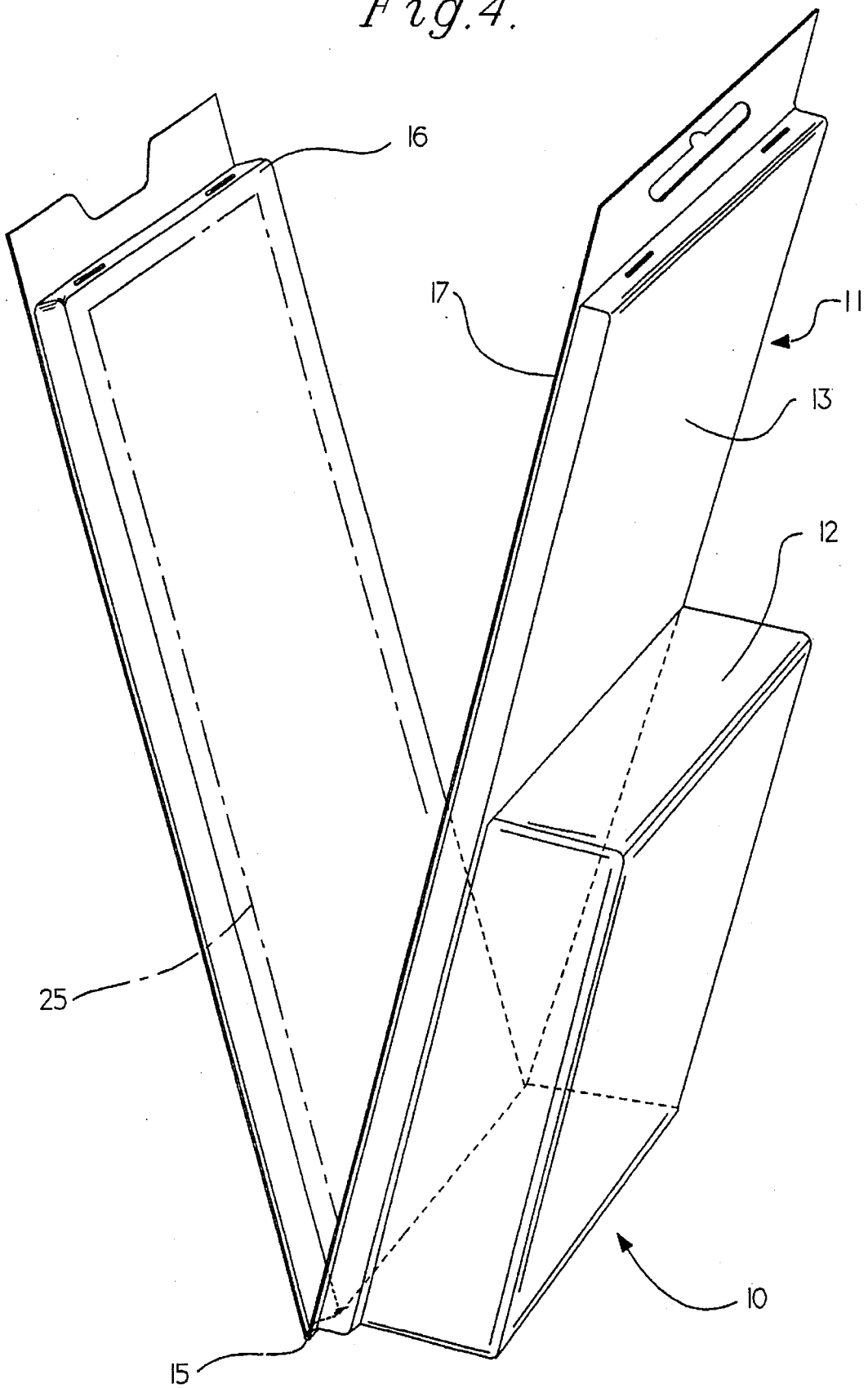
FIG. 4 is a perspective view of the present preferred blister package in a partially open position.
Figure 6:
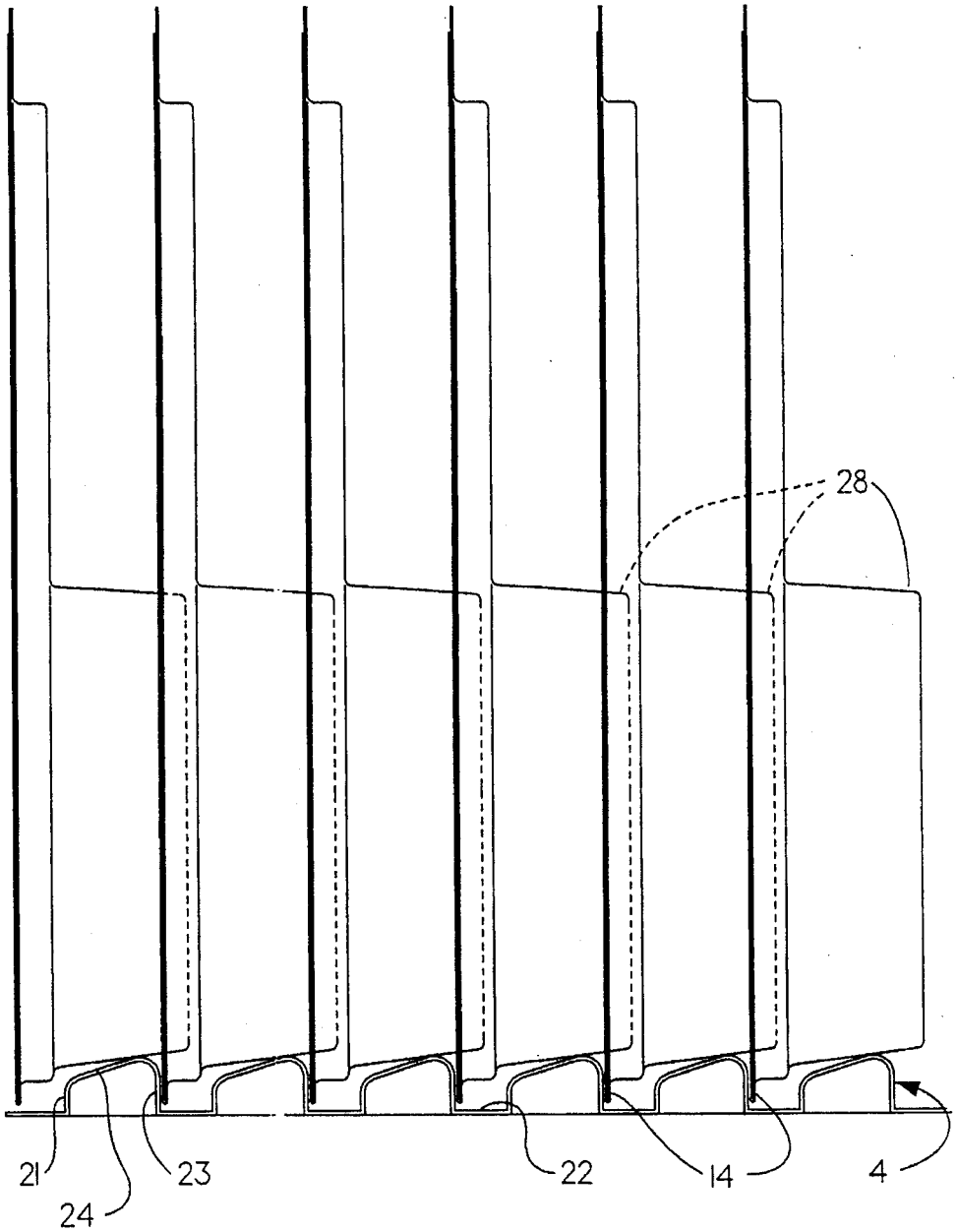
FIG. 6 is a side view showing the present preferred blister packages being held by the insert.
Figure 5:
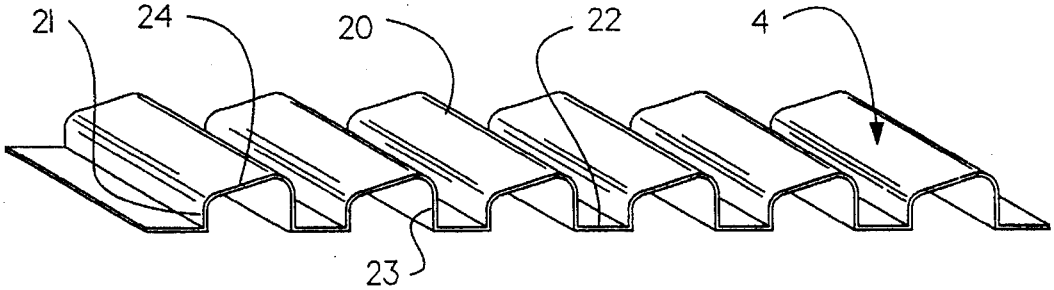
FIG. 5 is a perspective view of the insert used in the present system.

The present preferred blister package 10 is formed to have a clear plastic front portion 11 with a bubble 12 that extends from cover 13. Cover 13 defines a cavity 17. The back portion 14 has a raised landing 16 which snap fits into cavity 17. Preferably, mating detents or other locking means are provided at the top of the cover 13 and landing 16 as shown in FIG. 4. In a preferred package the back portion 14 and front portion 11 are both plastic and molded to have a hinge 15. A card or label 25 may be placed on the landing 16. The bubble 12 has a flat bottom 19 which is preferably at an angle $\alpha$ relative to a line 18 perpendicular to the landing. Thus, when the blister package is placed within the shipping tray the bottom surface of the blister will rest on the top of a peak 20 in the tray 4 thereby holding the blister package in an upright position. Because the peak is sloped and the blister card is slightly above the bottom of the valley, the peaks tend to push the packages backwards. Furthermore, the front portion 28 of each blister 12 is sized to nest within the cavity formed by the landing 16 of the blister package in front of it as shown in FIG. 5. This provides stability. Hence, each blister package will remain in an upright position even if blister packages in front of it are removed from the tray.

As seen most clearly in FIGS. 4 and 5 the insert 4 has a series of peaks 20 and valleys 22. The valleys 22 are sized and spaced so that the rear portion 14 of each blister package fits securely within a valley. Each peak 20 has a rear wall 21, front wall 22 and top 23. The top 23 is sloped from the front wall to the back wall of the peak. Preferably, the slope rises at an angle between 50 and 70 degrees from horizontal.

I prefer that the tray be made of vacuum formed polycarbonate or polypropylene. The tray may also be injection molded. Preferably, the peaks are sized to have a front wall of 3/16", a rear wall of 1/4" and a slope of 70 degrees. The valleys are preferably 3/4" inches wide.

Although I have shown and described certain present preferred embodiments of my blister card display system, it should be distinctly understood that my invention is not limited thereto, but may be variously embodied within the scope of the following claims.

I claim:

1. A system for displaying packaged goods comprising:

a. an insert sized to be placed on a bottom surface of a packaging carton, the insert having a plurality of alternating peaks and valleys, each peak comprised of a front wall, a rear wall and a top extending from the front wall to the rear wall, each valley being sized to receive a bottom portion of a blister package; and b. a plurality of blister packages arranged in a front to back relationship, each blister package having:

i. a back portion containing a cavity;

ii. a front portion containing a blister; and iii. a bottom edge located within a valley in the insert such that for each pair of adjacent blister packages at least a portion of the blister of one blister package is fitted within the cavity of the adjacent blister package.

2. The system of claim 1 wherein the rear wall has a height of about 1/4", the front wall has a height of about 3/16" and the valley has a width of about 3/4".

3. The system of claim 1 wherein the plurality of blister packages are each comprised of a. a front portion having a front cavity portion and the blister portion; and b. a rear portion pivotally, attached to the front portion at one edge thereof, the rear portion having a landing which fits within the front cavity portion of the front portion.

4. The system of claim 1 wherein the blister in each of the plurality of blister packages has a sloped bottom.

5. The system of claim 1 wherein the insert is vacuum formed from one of polycarbonate and polypropylene.

6. The system of claim 1 also comprising a packing carton having a bottom surface on which the insert is placed.

* * * * *